US006706672B2

(12) United States Patent
Kelley

(10) Patent No.: US 6,706,672 B2
(45) Date of Patent: Mar. 16, 2004

(54) ENGINE LUBRICANT USING MOLYBDENUM DITHIOCARBAMATE AS AN ANTIOXIDANT TOP TREATMENT IN HIGH SULFUR BASE STOCKS

(75) Inventor: Jack C. Kelley, Chagrin Falls, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 1 day.

(21) Appl. No.: 10/091,722

(22) Filed: Mar. 6, 2002

(65) Prior Publication Data

US 2003/0134754 A1 Jul. 17, 2003

Related U.S. Application Data

(60) Provisional application No. 60/278,052, filed on Mar. 22, 2001, and provisional application No. 60/290,081, filed on May 10, 2001.

(51) Int. Cl.[7] ..... C10M 141/12

(52) U.S. Cl. ..... 508/287; 508/365; 508/376; 508/563; 508/567; 508/584

(58) Field of Search ..... 508/363, 364, 508/365, 287

(56) References Cited

U.S. PATENT DOCUMENTS

| | | | | | |
|---|---|---|---|---|---|
| 2,466,517 | A | | 4/1949 | Blair et al. | 252/8.55 |
| 3,541,014 | A | | 11/1970 | Le Suer | 252/49.7 |
| 4,178,258 | A | | 12/1979 | Papay et al. | 252/32.7 |
| 4,234,435 | A | | 11/1980 | Meinhardt et al. | 252/51.5 A |
| 4,265,773 | A | | 5/1981 | deVries et al. | 252/46.4 |
| 4,285,822 | A | | 8/1981 | deVries et al. | 252/46.4 |
| 4,529,526 | A | | 7/1985 | Inoue et al. | 252/32.7 |
| 4,846,983 | A | | 7/1989 | Ward, Jr. | 252/33.6 |
| 4,904,401 | A | | 2/1990 | Ripple et al. | 252/32.7 E |
| 4,981,602 | A | | 1/1991 | Ripple et al. | 252/5.15 |
| 5,281,347 | A | | 1/1994 | Igarashi et al. | 252/42.7 |
| 5,605,880 | A | | 2/1997 | Arai et al. | 508/379 |
| 5,650,381 | A | * | 7/1997 | Gatto et al. | 508/364 |
| 5,744,430 | A | | 4/1998 | Inoue et al. | 508/295 |
| 5,840,672 | A | | 11/1998 | Gatto | 508/334 |
| 5,994,277 | A | * | 11/1999 | Ritchie et al. | 508/365 |
| 6,074,993 | A | * | 6/2000 | Waddoups et al. | 508/364 |
| 6,174,842 | B1 | * | 1/2001 | Gatto et al. | 508/364 |
| 6,300,291 | B1 | * | 10/2001 | Hartley et al. | 508/363 |
| 6,444,624 | B1 | * | 9/2002 | Walker et al. | 508/363 |
| 6,500,786 | B1 | * | 12/2002 | Hartley et al. | 508/365 |

FOREIGN PATENT DOCUMENTS

| | | |
|---|---|---|
| EP | 609 623 | 8/1994 |
| EP | 686 689 | 12/1995 |
| EP | 725 130 | 8/1996 |
| EP | 281 992 | 9/1998 |

OTHER PUBLICATIONS

Presentation, forum unknown, "Anti–War Performance of Adeka Sakura–Lube," Feb. 19, 1998.

* cited by examiner

*Primary Examiner*—Ellen M. McAvoy
(74) *Attorney, Agent, or Firm*—David M. Shold; Michael F. Esposito

(57) ABSTRACT

A composition comprising: a high-sulfur API Group I mineral oil base stock; a molybdenum dithiocarbamate in an amount suitable to provide 50 to about 600 ppm molybdenum to the composition; a succinimide dispersant based on a polyolefin-substituted succinic structure, where the polyolefin has a number average molecular weight of at least 1500; a zinc dialkyldithiophosphate derived from at least one secondary alcohol; and a hindered phenol, alkylated aromatic amine, or sulfurized olefin oxidation inhibitor, is capable of passing a Sequence III test.

12 Claims, No Drawings

ENGINE LUBRICANT USING MOLYBDENUM DITHIOCARBAMATE AS AN ANTIOXIDANT TOP TREATMENT IN HIGH SULFUR BASE STOCKS

CROSS-REFERENCE TO RELATED APPLICATIONS

This application claims priority from U.S. Provisional Application 60,278,052, Mar. 22, 2001, and U.S. Provisional Application 60/290,081, May 10, 2001.

BACKGROUND OF THE INVENTION

The present invention relates to the engine oils formulated the meet the new specifications of ILSAC GF-3 using conventional high sulfur base stocks.

Lubricating base stocks or base oils have been categorized into Groups I–V by the American Petroleum Institute (API). They are characterized by their sulfur content, "saturates" or paraffin content and their viscosity index. Group I and II are most abundant base stocks and most commonly used to formulate engine lubricants. Group I base stocks are typically much higher in sulfur content than Group II. The trend is toward Group II base stocks which are both low in sulfur and low in aromatic content. The problem presented to the lubricating oil additive supplier is to formulate a performance additive package for both types of oils, often for the same customer. The performance of a lubricant is demonstrated by passing engine tests (ASTM sequence tests.) The engine testing is a costly investment for the additive supplier. The Sequence IIIF test, a General Motors developed test that measures oxidation and wear among other properties, is one of the engine tests that is sensitive to the starting base oil. An additive package formulated to pass the IIIF test in Group II base stocks may not be adequate for Group I base stocks. This results in multiple formulations and engine testing and will often require two separate additive packages. This is not always economical or convenient for the additive supplier or the customer, the lubricating oil manufacturer.

Lubricating oils containing molybdenum compounds like molybdenum dithiocarbamates (MoDTCs) have been known in the literature. Le Suer in U.S. Pat. No. 3,541,014 showed the value of using oil soluble molybdenum compounds in lubricants in combination with other additives to improve extreme pressure capabilities and antiwear properties of the lubricants. Papay et al. in U.S. Pat. No. 4,178,258 discloses a lubricating oil composition suitable for use in an internal combustion engine, comprising a major amount of a mineral oil and a minor wear and friction reducing amount of an oil soluble molybdenum dithiocarbamate (MoDTC). Inoue et al. in U.S. Pat. No. 4,529,526 discloses a lubricant consisting essentially of a base oil, a molybdenum dithiophosphate (MoDTP) or a MoDTC, a zinc dithiophosphate with at least 50% secondary alkyl groups, an overbased calcium sulfonate and a succinimide dispersant or boron derivative thereof. In U.S. Pat. No. 4,846,983 Ward teaches the production of a molybdenum dithiocarbamate (MoDTC) based on a primary amine and further showed the value in using the MoDTC as an oxidation inhibitor in a Oldsmobile Sequence IIID test, a second generation predecessor of the Sequence IIIF test.

Several patents teach the use of molybdenum compounds in engine oil for use in low sulfur and/or low aromatic content base oils, often in combination with other oxidation inhibitors. For example U.S. Pat. No. 5,281,347 to Igarashi et al. shows the use of a MoDTC in a hydrocracked oil with a sulfur content of less than 50 parts per million (ppm) and a aromatic content of 3–15%. U.S. Pat. No. 5,605,880 to Arai et al. claims the combination of a MoDTC and an aromatic amine in a base oil which has less than 50 ppm sulfur and less than 3% aromatic content.

The present invention solves the problem of oxidation in high sulfur (greater than 300 ppm) Group I base stocks by top treating (i.e., supplementing) an additive formulation designed for Group II base stocks with a MoDTC. This top treatment is shown to be effective in the Sequence IIIF engine test. The base formulation designed for Group II base stocks contains a high molecular weight succinimide dispersant, an overbased calcium sulfonate, a zinc dithiophosphate and other oxidation inhibitors such as a sulfurized olefin, a hindered phenol, or an alkylated diphenylamine. The invention is particularly suitable for use with lubricant formulations in high sulfur Group I base stocks which fail the Sequence IIIF oxidation test without the added MoDTC.

SUMMARY OF THE INVENTION

The present invention provides a composition suitable for qualifying as an ILSAC GF-3 engine lubricating oil comprising the following components: a major amount of a mineral oil classified as an API Group I base stock, wherein said base stock contains 300 ppm or more of sulfur by weight, a molybdenum dithiocarbamate in an amount to deliver 25–600 ppm of molybdenum to the finished engine oil, a succinimide dispersant having a polyolefin backbone, where the polyolefin has a number average molecular weight of at least 1300, a zinc dialkyldithiophosphate derived from at least one secondary alcohol, and at least one oxidation inhibitor selected from the group consisting of hindered phenols, alkylated aromatic amines, and sulfurized olefins.

The present invention further provides a method for inhibiting oxidation in an ASTM Sequence IIIF test when using high sulfur API Group I base stocks, comprising the following steps: treating a high sulfur Group I base stock with an additive package which is capable a passing a Sequence IIIF test when formulated in Group II base stocks; and adding to said base stock a MoDTC in an amount suitable to deliver 25–600 ppm of molybdenum to the finished lubricating oil.

The additive package capable of passing the Sequence IIIF test typically comprises a succinimide dispersant having a polyolefin backbone, where the polyolefin has a number average molecular weight of at least 1300; a zinc dialkyldithiophosphate derived from at least one secondary alcohol; and at least one oxidation inhibitor selected from the group consisting of hindered phenols, alkylated aromatic amines, and sulfurized olefins.

DETAILED DESCRIPTION OF THE INVENTION

Various preferred features and embodiments will be described below by way of non-limiting illustration.

Component (a) is a mineral oil having a sulfur content of greater than 300 ppm, preferably greater than 500, 700, 1000, or even 1500 ppm by weight. Some such mineral oils will have an even higher sulfur content, of 2000 or even 4000 ppm. Not all base oils have similar physical or chemical properties or provide equivalent engine performance when formulated with the same additives. The American Petroleum Institute (API) Base Oil Interchangeability Guidelines were developed to ensure that the performance of engine oil products is not adversely affected when different base oils are used interchangeably. The guidelines define the minimum physical and engine testing needed to ensure satisfactory performance when substituting one base stock for another. It is often found that changes in the chemical additives will be necessary when changing to a different base stock.

The API Base Oil Interchange Guidelines have established five base oil groups for interchanging base stocks.

| Base Oil Category | Sulfur (%) | | Saturates (%) | Viscosity Index |
|---|---|---|---|---|
| Group I | >0.03 | and/or | <90 | 80 to 120 |
| Group II | ≦0.03 | and | ≧90 | 80 to 120 |
| Group III | ≦0.03 | and | ≧90 | ≧120 |
| Group IV | All polyalphaolefins (PAOs) | | | |
| Group V | All others not included in Groups I, II, III or IV | | | |

Groups I, II, and III are mineral oil base stocks. Component (a) being high sulfur would be a Group I base oil. The high sulfur oils are a subset of the Group I base oils. The present invention is also useful in mixtures of various Groups of base oils, provided that the sulfur level in the total base stock mixture is at least 300 ppm. For example, a major amount of a high sulfur Group I base stock could be mixed with smaller amounts of base stocks from one or more of Groups II, III, IV, or V.

The amount of component (a) in the compositions of the present invention is generally 50% or greater. Preferably the amount of component (a) is 70 to 96%. More preferably the amount of component (a) is 85 to 95%.

Component (b) is one or more molybdenum dithiocarbamates (MoDTC). Molybdenum dithiocarbamates (or, commonly, molybednum dihydrocarbyldithiocarbamates) are generally represented by the formula $$[R_1R_2N\text{-}C(=S)S\text{-}]_2\text{-}(Mo_2S_mO_n)$$

where $R_1$ and $R_2$ are the same or different hydrocarbyl groups such as alkyl groups, or hydrogen; typically $R_1$ and $R_2$ are $C_8$ to $C_{18}$ hydrocarbyl groups; m and n are positive integers whose total is 4.

Specific examples of MoDTCs include commercial materials such as Vanlube™ 822 and Molyvan™ A from R. T. Vanderbilt Co., Ltd., and Adeka Sakura-Lube™ S-100, S-165 and S-600 from Asahi Denka Kogyo K. K. Other molybdenum dithiocarbamates are described by Tomizawa in U.S. Pat. No. 5,688,748; by Ward in U.S. Pat. No. 4,846,983; by deVries et al. in U.S. Pat. No. 4,265,773; and by Inoue et al. in U.S. Pat. No. 4,529,536. The total of m+n is 4, and typically m is 1–4 and n is 0–3; preferably m is 2–4 or 2–3 and n is 0–2 or 1–2, respectively. In a particularly preferred material m is 2 and n is 2.

$R_1$ and $R_2$ can each be independently not only hydrocarbyl groups, but also aminoalkyl groups or acylated aminoalkyl groups. More generally, any such R groups are derived from a basic nitrogen compound (comprising the structure $R_1$—N—$R_2$) as described in detail in U.S. Pat. No. 4,265,773. If they are hydrocarbyl groups, they can be alkyl groups of 4 to 24 carbons, typically 6 to 18 carbons, or 8 to 12 carbons. A useful C-8 group is the 2-ethylhexyl group; thus, the di-2-ethylhexyl dithiocarbamate is a preferred group.

The aminoalkyl groups which can serve as $R_1$ or $R_2$ typically arise from the use of a polyalkylenepolyamine in the synthesis of the dithiocarbamate moiety. Typical polyalkenepolyamines include ethylenediamine, diethylenetriamine, triethylenetetramine, tetraethylenepentamine, pentaethylenehexamine, and corresponding higher homologues, and mixtures thereof Such polyamines are described in detail under the heading Ethylene Amines in Kirk Othmer's "Encyclopedia of Chemical Technology", 2d Edition, Vol. 7, pages 22–37, Interscience Publishers, New York (1965). Such polyamines can be prepared by the reaction of ethylene dichloride with ammonia or by reaction of an ethylene imine with a ring opening reagent such as water or ammonia. These reactions result in the production of a complex mixture of polyalkylenepolyamines including cyclic condensation products such as piperazines, which mixtures are also useful. Other useful types of polyamine mixtures are those resulting from stripping of the above-described polyamine mixtures to leave as residue what is often termed "polyamine bottoms."

$R_1$ and $R_2$ can be acylated aminoalkane groups, particularly arising from the use of an acylated polyalkylenepolyamine in the synthesis of the dithiocarbamate moiety. Acylated polyalkylenepolyamines typically find use as dispersants for lubricating applications. If a hydrocarbyl diacid such as hydrocarbyl-substituted succinic acid or anhydride is reacted, as the acylating agent, with a polyalkenepolyamine, the product is typically known as a succinimide dispersant. If a monocarboxylic acid, such as iso-stearic acid, is used as the acylating agent, the resulting product will typically be an amide, although cyclization to form an imidazoline structure can also occur. All such materials are well known to those skilled in the art. Succinimide dispersants and their synthesis are disclosed, for instance, in U.S. Pat. No. 4,234,435. Imidazolines are disclosed in U.S. Pat. No. 2,466,517.

The preparation of molybdenum thiocarbamates from the above basic nitrogen compounds is described in greater detail in U.S. Pat. No. 4,265,773. In brief, they are prepared by the reaction of an acidic molybdenum compound such as molybdic acid, with the basic nitrogen compound, and subsequent reaction with carbon disulfide.

The amount of component (b) in the compositions of the present invention is generally an amount to deliver 25–600 ppm by weight of molybdenum (Mo) to the fully formulated lubricating oil. Alternatively, the amount of component (b) gives 50–500 or 70–500, 100–450, 150–250, or 60–100 ppm of Mo.

Component (c) is a succinimide dispersant having or derived from a polyolefin backbone, where the polyolefin has a number average molecular weight of at least 1300. Specific examples of this type of component include polyisobutylene succinimide prepared by the reaction of a polyisobutylene succinic anhydride or acid with polyamines such as tetraethylenepentamine (TEPA) or heavy polyamines such polyamine bottoms such as Dow™ E-100 or Union Carbide™ HPA-X, or mixtures of heavy polyamines with diethylenetriamine (DETA) or triethylenetetraamine (TETA). The number average molecular weight of the polyolefin from which dispersant is derived is preferably 1300 to 5000 and more preferably 1500 to 3000. The most preferred dispersant is derived from a polyolefin succinic acid or anhydride where the average number of succinic groups per polyolefin group is greater than 1.3, and more specifically 1.3 to 2.5. Preferably the polyolefin is polyisobutylene. Dispersants of this type are disclosed by Meinhardt et al. in U.S. Pat. No. 4,234,435. They are further described in engine oil formulations by Ripple et. al in U.S. Pat. Nos. 4,904,401 and 4,981,602, and their use in combination with component (d) is disclosed. In a preferred embodiment the polyamine is reacted with the succinic acid or anhydride at 0.70 to less than 1.0 nitrogen atoms (N) to 1 carbonyl group (CO). In another embodiment the reaction ratio (i.e., mole ratio) is 1.0 to 1.5 N per CO.

The amount of component (c) in the compositions of the present invention is generally 0.4–10% by weight. Preferably the amount of component (c) is 1 or 2 to 8%. More preferably the amount of component (c) is 2.2 or 2.5 to 6%. When relatively lower amounts of the dispersant, component (c), are employed, it may be desirable to include additional dispersant functionality by means of including an appropriate amount of a dispersant-viscosity modifier.

Component (d) is a zinc dialkyldithiophosphate derived from at least one secondary alcohol. These materials commonly used in engine oils and are known as ZDDPs or ZDTPs. The ZDDPs of this invention can be derived from secondary alcohols exclusively or or mixtures of secondary and primary alcohols. They are usually manufactured by the reaction of an alcohol or mixture of alcohols with phosphorus pentasulfide and subsequently neutralizing the resultant dialkyldithiophosphoric acid with zinc oxide (ZnO). Preferably at least mole 20%, and more preferably at least mole 30%, of the alcohol is isopropyl or secondary butyl. Specific examples of this type of component include those derived from a 40:60 mole ratio mixture of 4-methyl-2-pentanol and isopropyl alcohol, a 60:40 mole ratio of the foregoing mixture, a 40:60 mole ratio mixture of 2-ethylhexanol (a primary alcohol) and isopropyl alcohol, or a 30:70 mole ratio mixture of 4-methyl-2-pentanol and sec-butyl alcohol, or a 35:65 mole ratio of isononyl alcohol and isopropyl alcohol.

The amount of component (d) in the compositions of the present invention is generally enough to deliver at least 0.03 percent by weight of phosphorus (P) to the final formulated lubricating oil. Preferably the amount of component (d) used is that amount which delivers 0.05 or 0.07–0.16% P. More preferably the amount of component (d) is that which delivers 0.08–0.13% P. The actual amount of component (d) can be readily determined by dividing the foregoing numbers by the fraction of P in the particular chemical used.

Component (e) is at least one oxidation inhibitor selected from the group consisting of hindered phenols, alkylated aromatic amines and sulfurized olefins. These oxidation inhibitors are typically referred to as "ashless" inhibitors. (The term "ashless" means that the oxidation inhibitor itself does not generate significant sulfated ash when subjected to ASTM D874. Practically speaking, this normally means that the oxidation inhibitor does not contain a significant amount of metal in its original form, although in actual use metals present in the lubricant may associate with the oxidation inhibitor. Such association does not take the oxidation inhibitor outside the scope of the present invention. Also, contamination by small amounts of metal, e.g., less that 0.005% percent by weight, is to be ignored.) These families of oxidation inhibitors are well known for their use in engine oils. Specific examples of useful hindered phenols include: 2,6-di-t-butyl phenol; 4-dodecyl-2,6-di-t-butylphenol and ester-containing hindered phenols such as Irganox™ L 135 supplied by Ciba. Specific examples of alkylated aromatic amines include alkylated phenyl alpha naphthyl amines such as Irganox™ L 06 from Ciba, alkylated diphenylamines such as Irganox™ L 57 from Ciba, and nonylated diphenylamines including mixtures of mono and dinonylated diphenylamine. Specific examples of sulfurized olefins include: sulfurized fats, sulfurized mixtures of fats and alpha olefins, and sulfurized Diels-Alder adducts of butadiene and n-butyl acrylate. Preferred embodiments the invention include at least two of the foregoing oxidation types. Another embodiment would include three.

The amount of component (e) in the compositions of the present invention is generally 0.5% or greater by weight. Preferably the amount of component (e) is 0.5 to 3.5% or to 2%. More preferably the amount of component (e) is 0.7–1.5%. A particularly advantage of this invention is that the use of that component (b), the MoDTC, in the formulation including (a)–(e) allows the component (e) to be used at cost effective levels. Table I, comparative example 10 shows that higher levels of (e) will give a pass result without (b), but the costs is much higher than that of the inventive combination.

The composition described above is prepared by blending the components into a concentrate or directly in the oil at normal blending temperatures, typically 50–100° C. the order of blending is not particularly important, although in some instances the MoDTC may be added to an oil composition already containing the other components.

Other components which are conventionally employed in an engine oil may typically also be present. Among such components are overbased detergents such as disclosed in U.S. Pat. No. 5,981,602 (particularly calcium or magnesium sulfonates or phenates), friction modifiers such as glycerol monooleate, oleamide, or fatty dimer acids, foam inhibitors, viscosity modifiers, dispersant viscosity modifiers and pour point depressants.

Testing of the compositions described above is carried out by the using the ASTM Sequence IIIF test. This a test designed to measure wear and oxidation performance as well as other properties of a fully formulated engine lubricant. A pass result is required to satisfy one of the requirements of ILSAC GF-3, a lubricant standard required for obtaining an API license for commercialization. ILSAC is the International Lubricant Standardization and Approval Committee. Standards such as GF-3 are a cooperative development by automobile and engine manufacturers from around the world. The viscosity increase of the oil is the main measure of oxidation performance of the oil formulation in this test. A viscosity increase of less than 275% at the end of the 80 hour test is required to pass. Table I shows certain formulations (amounts in weight % except as noted) and GF-3 test results. Example 1 is formulated in Group II base stocks and gives a pass result. Example 2, the comparative example using same formulation in a high sulfur Group I base stock, gives a fail result. Examples 3 to 6 are all comparative examples using the base formulation of Example 2 and adding additional ashless oxidation inhibitors. Example 7 shows a comparative result using the a known viscosity increase inhibitor copper dithiophosphate added at 100 ppm, a level known to be effective in earlier generations of Sequence III tests. Finally the inventive examples 8 and 9 show that the addition of MoDTC to deliver 500 or even 150 ppm Mo is effective in this formulation, giving pass results.

| | EXAMPLES | | | | | | | | | |
|---|---|---|---|---|---|---|---|---|---|---|
| Comments: | 1‡ Group II IIIF Pass | 2* Group I Baseline IIIF Fail | 3* Base + Hindered Phenol | 4* Base + Hindered Phenol & Amine | 5* Base + Sulfur | 6* Base + Amine & Sulfur | 7* Base + Cu DDP (100 ppm Cu) | 8 Base + 500 ppm Mo | 9 Base + 150 ppm Mo | 10* Base + Higher Levels of Inhibitors |
| Base Stock | Group II[5] | Group I[6] | Group I | Group I | Group I | Group I | Group I | Group I | Group I | Group I |
| VM[1] | 0.95 | 0.76 | 0.86 | 0.86 | 0.86 | 0.86 | 0.86 | 0.86 | 0.86 | 0.86 |
| PPD[2] | 0.09 | 0.09 | 0.09 | 0.09 | 0.09 | 0.09 | 0.09 | 0.09 | 0.09 | 0.09 |
| Succinimide Dispersant[3] | 2.3 | 2.3 | 2.3 | 2.3 | 2.3 | 2.3 | 2.3 | 2.3 | 2.3 | 2.3 |
| ZDDP[4] | 0.88 | 0.88 | 0.88 | 0.88 | 0.88 | 0.88 | 0.88 | 0.88 | 0.88 | 0.88 |
| Alkylated Di-phenylamine | 0.70 | 0.70 | 0.70 | 1.50 | 0.70 | 1.50 | 0.70 | 0.70 | 0.70 | 1.50 |
| Cu DDP[7] | — | — | — | — | — | — | 100 ppm Cu | — | — | — |
| Sulfurized Olefin | 0.20 | 0.20 | 0.20 | 0.20 | 0.70 | 0.60 | 0.20 | 0.20 | 0.20 | 0.20 |
| Hindered Phenol | 0.20 | 0.20 | 0.70 | 0.60 | 0.20 | 0.20 | 0.20 | 0.20 | 0.20 | 1.10 |
| MoDTC (Adeka ™ S-100) | — | — | — | — | — | — | — | 1.20 | 0.36 | — |
| Overbased Calcium Sulfonate | 0.89 | 0.89 | 0.89 | 0.89 | 0.89 | 0.89 | 0.89 | 0.89 | 0.89 | 0.89 |
| Friction Modifier | 0.2 | 0.5 | 0.2 | 0.2 | 0.2 | 0.2 | 0.2 | 0.2 | 0.2 | 0.2 |
| Silicone Foam Inhibitor (ppm) | 90 | 90 | 90 | 90 | 90 | 90 | 90 | 90 | 90 | 90 |
| Sequence IIIF | Pass | Fail | Fail | Fail | Fail | Fail | Fail | Pass | Pass | Pass |
| % Vis Increase (max allowed 275) | 35.5 | 6036 | 2274 | 2581 | 552.1 | 33840 | 11243 | 88.9 | 132.4 | 107.5 |

Footnots to Table I
‡reference example
*comparative example
[1]Viscosity Modifier - olefin copolymer enough a make a 10W40 visosity grade for all samples.
[2]Pour Point Depressant
[3]Succinimide dispersant from 2000 Mn polyisobutylene, reacted with maleic anhydride to give an average of about 2 succinic groups per polyisobutylene group and further reacted with ethylene polyamines at about 5 N per 6 carboxy groups.
[4]ZDDP from 4-methyl-2-pentanol and isopropyl alcohol.
[5]A Group II base oil having a sulfur content of 67 ppm.
[6]A Group I base oil have a sulfur content of 2490 ppm.
[7]A copper dialkyldithiophosphate It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amount, range, and ratio limits set forth herein may be independently combined, and the range of one component may be selected independently of the range of any other component, unless otherwise indicated. As used herein, the expression "consisting essentially of" permits the inclusion of substances which do not materially affect the basic and novel characteristics of the composition under consideration.

What is claimed is:

1. A composition comprising:

(a) a major amount of an API Group I mineral oil base stock containing at least 300 ppm sulfur by weight;

(b) a molybdenum dithiocarbamate in an amount suitable to provide about 25 to about 600 ppm molybdenum to the composition;

(c) a succinimide dispersant based on a polyolefin-substituted succinic structure, where the polyolefin has a number average molecular weight of at least about 1300;

(d) a zinc dialkyldithiophosphate derived from at least one secondary alcohol; and (e) at least one oxidation inhibitor selected from the group consisting of hindered phenols, alkylated aromatic amines, and sulfurized olefins.

2. The composition of claim 1 wherein the mineral oil base stock contains at least 1000 ppm sulfur by weight.

3. The composition of claim 1 wherein the molybdenum dithiocarbamate is represented by the formula $$[R_1R_2N-C(=S)S-]_2-(Mo_2S_mO_n)$$

wherein $R_1$ and $R_2$ are independently hydrocarbyl groups, aminoalkyl groups, or acylated aminoalkyl groups, m is 2 and n is 2.

4. The composition of claim 1 wherein the amount of the molybdenum dithiocarbamate is suitable to provide about 50 to 500 ppm by weight molybdenum to the composition.

5. The composition of claim 1 wherein the polyolefin substituent on the succinimide dispersant is polyisobutene having a number average molecular weight of 1500 to 3000; there are an average of about 1.3 to about 2.5 succinic groups on each polyisobutene group; and the amine portion of the succinimide is a mixture of ethylene polyamines, which is reacted in an amount to provide a CO:N mole ratio of about 0.7 to about 1.5.

6. The composition of claim 1 wherein the amount of the succinimide dispersant is about 0.4 to about 10 percent by weight of the composition.

7. The composition of claim 1 wherein the zinc dialkyldithiophosphate is derived from 4-methyl-2-pentanol or isopropyl alcohol or mixtures thereof.

8. The composition of claim 1 wherein the amount of the zinc dialkyldithiophosphate is an amount suitable to provide about 0.03 to about 0.16 weight percent phosphorus to the composition.

9. The composition of claim 1 wherein at least two oxidation inhibitors are present.

10. The composition of claim 1 wherein the amount of the oxidation inhibitors is about 0.5 to about 3.5 weight percent of the composition.

11. A method for inhibiting oxidation in high sulfur API Group I base stocks, comprising the following steps:

(a) adding to said base stock an additive package which is capable of passing a Sequence IIIF test when formulated in Group II base stocks; and (b) adding to said base stock a molybdenum dithiocarbamate in an amount sufficient to deliver about 25 to about 600 ppm of molybdenum to the composition.

12. The method of claim 11 wherein the additive package of (a) comprises (i) a succinimide dispersant based on a polyolefin-substituted succinic structure, where the polyolefin has a number average molecular weight of at least about 1500;

(ii) a zinc dialkyldithiophosphate derived from at least one secondary alcohol; and (iii) at least one oxidation inhibitor selected from the group consisting of hindered phenols, alkylated aromatic amines, and sulfurized olefins.

* * * * *